US007417654B2

(12) United States Patent
Preston et al.

(10) Patent No.: US 7,417,654 B2
(45) Date of Patent: Aug. 26, 2008

(54) MULTIPLE IMAGING MEDIA DISPENSING SYSTEMS AND METHODS

(75) Inventors: Todd K. Preston, Greece, NY (US); Richard A. Kalb, Greece, NY (US); James J Spence, Honeoye Falls, NY (US); Wayne Drinkwater, Fairport, NY (US); Michael J. Martin, Hamlin, NY (US); Robert A. Pictor, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 454 days.

(21) Appl. No.: 11/192,129

(22) Filed: Jul. 29, 2005

(65) Prior Publication Data

US 2007/0024689 A1 Feb. 1, 2007

(51) Int. Cl.
*G03G 21/00* (2006.01)

(52) U.S. Cl. ..... 347/140

(58) Field of Classification Search ..... 399/110, 399/111, 258–263; 347/140, 110, 111
See application file for complete search history.

(56) References Cited

U.S. PATENT DOCUMENTS

2006/0078355 A1* 4/2006 Yahagi ..... 399/258

* cited by examiner

*Primary Examiner*—Huan H Tran
(74) *Attorney, Agent, or Firm*—Oliff & Berridge, PLC

(57) ABSTRACT

Systems and methods of a multiple dispensing system may include an image carrier, and may include a plurality of substantially aligned developing units positioned to develop image information on the image carrier. Each developing unit may include only one ink container and only one developer housing. The systems and method may also include a first dispensing system positioned upstream in a sheet feed direction of the plurality of substantially aligned developing units. The first dispensing system may include a first ink container and a first developer housing. The first developer housing may be configured to receive first imaging media from the first ink container and second imaging media from at least one other ink supply source.

20 Claims, 9 Drawing Sheets

MULTIPLE IMAGING MEDIA DISPENSING SYSTEMS AND METHODS

BACKGROUND

Exemplary systems described herein relate to the field of imaging media dispensing systems.

Imaging media, for example, wet or dry toner having common process colors, such as, cyan (C), magenta (M), yellow (Y) and black (K), are widely used by the imaging industry to develop images. An image forming apparatus including the four ink containers for CMYK, for example, may be used to produce images containing various colors by supplying the CMYK inks to an image bearing member, such as a developing drum or belt, of a developing unit of the image forming apparatus. Because the developing unit consumes the imaging media to develop the images, the imaging media located in the containers become substantially depleted. As a result, the depleted containers must eventually be refilled or removed from the image forming apparatus and replaced with containers that include additional imaging media.

SUMMARY

Although depleted ink containers may be refilled or replaced, an image forming apparatus that includes such ink containers may have various limitations. First, common CMYK inks may not be able to accurately produce desired colors because the gamut of the image forming apparatus may not be large enough to output the entire gamut of a specified print job. As a result of such problematic color matching, substantial differences may exist between the specified print job colors and the colors reproducible by the image forming apparatus.

Second, ink containers may be quickly depleted if inks are continually used to produce all equivalent colors for images of all print jobs. Therefore, the depleted containers must be frequently refilled or replaced. The process of refilling or replacing the depleted containers may be messy, difficult and time consuming. Specifically, the depleted containers may be difficult to access, complicated to replace, and require frequent replacement due to limited capacity of the containers. The imaging media also tend to spill during refilling and replacement of the depleted containers. As a result, replacing the depleted containers may be burdensome for an operator of the image forming apparatus. Therefore, reduction in replacement frequency may be desirable.

Reserve ink containers containing black ink are provided in various image forming apparatuses to provide additional imaging media when main ink cartridges have been depleted. As a result, the refill or replacement time of the main depleted container containing black ink may be postponed. However, the reserve ink containers must also eventually be refilled or replaced upon depletion. Further, the reserve ink containers may be affixed to the image forming apparatus at a hidden location. Therefore, the reserve ink containers may also be messy, difficult and time consuming to refill or replace.

Service representatives are typically relied on to refill and replace the depleted ink containers. However, reliance on the service representative may be time consuming, costly and inefficient because production of a print job may be halted until the service representative has completed the refilling and/or replacement of the containers. Further, it may be burdensome for the operator to personally replace or to call in a service representative to replace the depleted ink containers each and every time the containers are depleted. Therefore, additional imaging media supply sources may be desirable.

Although the refilling and/or replacement of certain types of depleted containers by service representatives may still be desirable due to complexities involved in refilling and replacement processes, it may be desirable to have an image forming apparatus that provides operators with an option of reducing an amount of servicing required from service representatives. Additionally, it may be desirable to reduce a frequency of ink container replacement, for example, upon depletion of the imaging media in the ink containers. Further, it may be desirable to provide more accurate colors specified in print jobs and increased color flexibility of image forming apparatus. Therefore, additional removable imaging media supply sources may be provided to simplify and reduce frequency of replacement of depleted containers, increase accuracy of color reproduction and/or increase color flexibility.

Such additional imaging media supply sources may include removable cartridges, for example, customer changeable units (CCUs), which may be more easily installed in and/or removed from an image forming apparatus by an operator. Such removable cartridges may include a developer housing and a dispensing system that includes an imaging media dispensing container with additional ink, such as common CMYK inks, a custom color that may be selected from the Pantone® Color Library, a clear toner, a white toner, magnetic ink character recognition (MICR) ink/toner and other types of developers. Therefore, the operator may easily change the removable cartridges to provide additional common inks and any desirable color that may be required for a particular print job.

As a result of additional removable cartridges, cost and lost production time for print jobs may be reduced. Also, color accuracy and color flexibility for a print job may be increased. However, the capacity of the removable cartridge may still be limited. Therefore, the removable cartridge may still require frequent replacement for print jobs requiring high area coverage and/or a significant use of one or more of desired colors, common CMYK colors and the like.

For example, a print job may include a background that requires significant use of black ink or trademarks that require significant use of custom colors. Removable cartridges may provide the operator with the flexibility to replace the removable cartridges depending on an amount of background area or custom colors on an as needed basis. Because the operator may easily change the removable cartridges, reliance on a service representative may not be necessary and production down time may be reduced. However, the operator may still be required to replace the removable cartridge each and every time the removable cartridge may be depleted.

To reduce frequency of replacing removable cartridges, a capacity of the removable cartridges may be increased. However, various ergonomic concerns arise with installing and removing a larger and heavier cartridge. Therefore, removable cartridges preferably remain small so that ergonomic concerns may be satisfied.

As such, a capacity of the removable cartridges may not be sufficient to significantly reduce frequency of cartridge replacement. Specifically, overall productivity of an image forming apparatus may be undesirably affected for large area coverage or large volume print jobs that may require significant amounts of a particular color. Constantly replacing depleted cartridge may result in productivity loss. Therefore, it may be desirable to provide an image forming apparatus that includes at least one larger additional imaging media dispensing system that may cooperate with the removable cartridge to increase color flexibility and frequency of replacement.

Exemplary embodiments may include a multiple dispensing system may include removable cartridges with an option of a fixed second dispensing system. The removable cartridges may dispense imaging media through a small container for small area coverage or small volume print jobs. The second dispensing system may dispense imaging media through a larger container for larger area coverage or larger volume print jobs because a hopper of the second dispensing system may be larger than a hopper of the removable cartridges. As a result, a larger hopper may provide additional time for an operator to recognize that a larger container of a second dispensing system may be depleting and replace the larger container.

Exemplary embodiments of a multiple dispensing system may include an image carrier, a plurality of substantially aligned developing units positioned to develop image information on the image carrier, each developing unit including only one ink container and only one developer housing, and a first dispensing system positioned upstream in a sheet feed direction of the plurality of substantially aligned developing units, the first dispensing system including a first ink container and a first developer housing, the first developer housing being configured to receive first imaging media from the first ink container and second imaging media from at least one other ink supply source.

The at least one other ink supply source may include a second dispensing system that dispenses the second imaging media to the first developer housing.

The second dispensing system may include a second ink container configured to store the second imaging media and to supply the second imaging media to the first developer housing.

The second dispensing system may also include an ink transporting mechanism configured to transport the second imaging media from the second ink container to the first developer housing.

The ink transporting mechanism include a pipe.

The ink transporting mechanism may be configured to support the second dispensing system.

The second ink container may include a larger storage capacity than a storage capacity of the first ink container.

The first developer housing may include a first ink supply port to receive the first imaging media from the first ink container and a second ink supply port to receive the second imaging media from the at least one other ink supply source.

Exemplary embodiment of the multiple dispensing system may form part of a xerographic device.

Exemplary embodiments of a method of dispensing imaging media may involve substantially aligning a plurality of developing units to develop image information on an image carrier, each developing unit including only one ink container and only one developer housing, providing a first dispensing system positioned upstream in a sheet feed direction of the plurality of substantially aligned developing units, the first dispensing system including a first ink container and a first developer housing, and positioning the first developer housing to receive first imaging media from the first ink container and second imaging media from at least one other ink supply source.

Exemplary embodiments may include feeding the first imaging media from the first ink container through a first ink supply port of the first developer housing.

Exemplary embodiments may include connecting a second dispensing system to the first developer housing, wherein the second dispensing system comprises at least one other ink supply source.

Exemplary embodiments may include feeding the second imaging media from the second ink container through a second ink supply port of the first developer housing.

Exemplary embodiments may include transporting the second imaging media to the first developer housing via an ink transporting mechanism.

Exemplary embodiments may include supporting the second dispensing system using the ink transporting mechanism.

Exemplary embodiments may include delaying feeding of at least one of the first imaging media and second imaging media until completion of the feeding of the other one of the first and second imaging media.

Exemplary embodiments of a method of dispensing imaging media may include obtaining electronic image data, substantially aligning a plurality of developing units to develop image information based on the electronic image data, each developing unit including only one ink container and only one developer housing, providing a first dispensing system positioned upstream in a sheet feed direction of the plurality of substantially aligned developing units, the first dispensing system including a first ink container and a first developer housing, and alternately feeding first imaging media from the first ink container and second imaging media from a second ink container to the first developer housing based on the electronic image data.

These and other features are described in or are apparent from the following detailed description.

BRIEF DESCRIPTION OF THE DRAWINGS

Various exemplary details are described herein, with reference to the following figures, wherein like numerals refer to like parts, and wherein.

DETAILED DESCRIPTION OF EMBODIMENTS

The following detailed description is directed to a multiple image dispensing systems of a specific type of image forming system, namely a color printing system. However, it should be appreciated that the description is for ease of understanding and familiarity only, and does not exclude other types of image forming systems, whether known or later developed.

Figure 1:
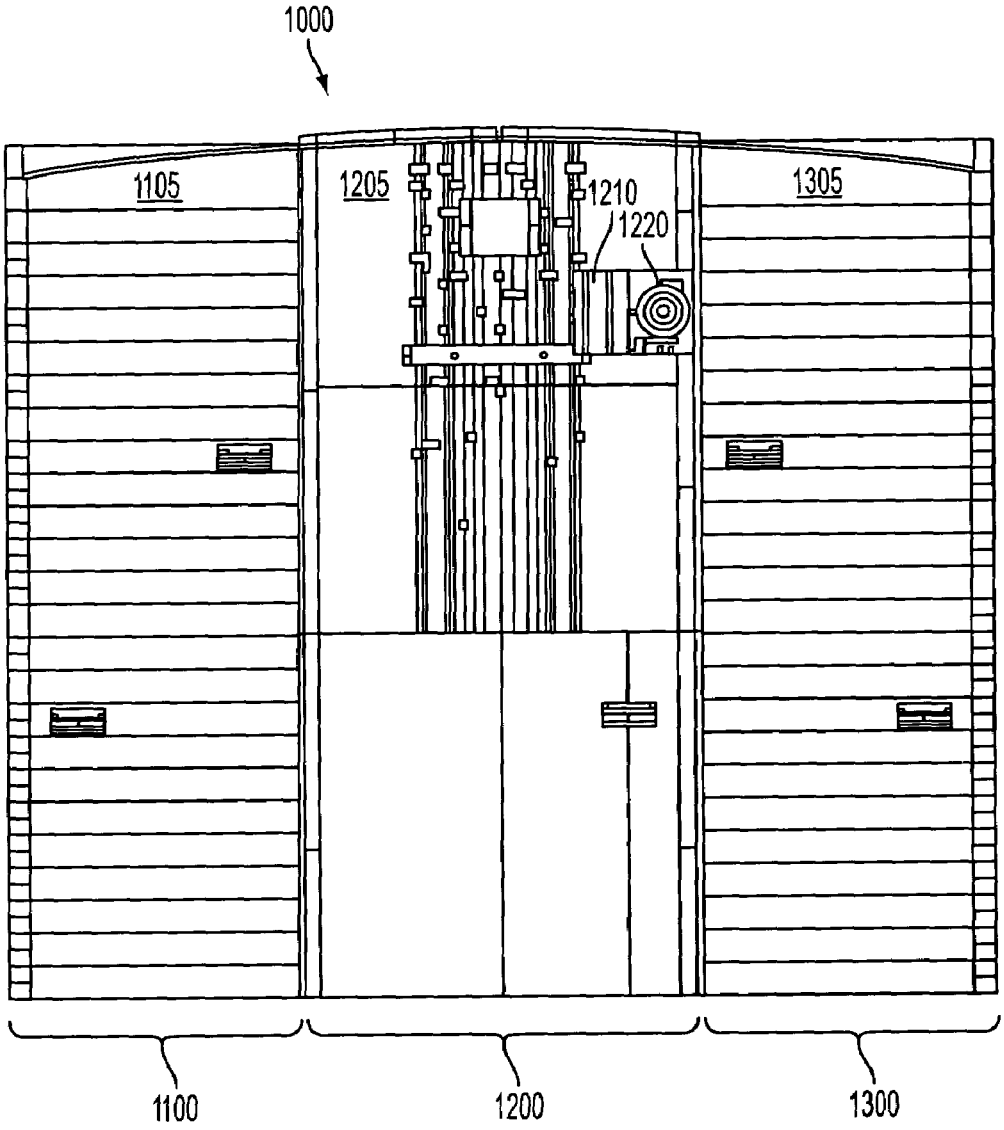
FIG. 1 is a front view of an exemplary first dispenser housing and an exemplary second dispenser housing of an image forming apparatus.

FIG. 1 is a front view of an exemplary first dispenser housing and an exemplary second dispenser housing of an image forming system 1000. The image forming system 1000 may include a vertical housing 1100, a first dispenser housing 1200 and a second dispenser housing 1300.

The vertical housing 1100 may include a front cover 1100 that provides access to an interior of the housing 1100. The interior of the vertical housing 1100 may contain portions of a sheet feed device that feeds recording sheets (not shown) in a sheet feeding direction F. The fed recording sheets may be received by the adjacent first dispenser housing 1200.

The first dispenser housing 1200 may also include a front cover 1205 that provides access to an interior of the housing 1200. A first dispenser housing door 1210 may also be provided in the front cover 1205 to provide partial access to a first dispensing system 1220 that may be located in the interior of the first dispenser housing 1200. The interior of the first dispenser housing 1200 may also include a plurality of substantially aligned, for example, vertically aligned, developing units. The developing units may include ink containers C, M, Y, K (shown in FIG. 3), for example, four dry ink containers, and corresponding developer housings 1, 2, 3, 4 (shown in FIG. 3), that supply ink to develop image information on an image carrier 1010 (shown in FIG. 3). Developed images may be transferred by the image carrier 1010 onto the recording sheets that may be subsequently fed to the second dispenser housing 1300.

The second dispenser housing 1300 may also include a front cover 1205 that provides access to an interior of the housing 1300. The interior of the second dispenser housing 1300 may contain a second dispensing system 1310 (shown in FIG. 4).

It should be appreciated that the vertical housing 1100, the first dispenser housing 1200 and the second dispenser housing 1300, while depicted separately in FIG. 1, are not necessarily separate and distinct components. The functions and/or operations of any one or more of these housings may be carried out by a single device, structure or system. Further, it should be appreciated that additional devices, structures and/or systems may be included in the image forming system 1000.

Figure 2:
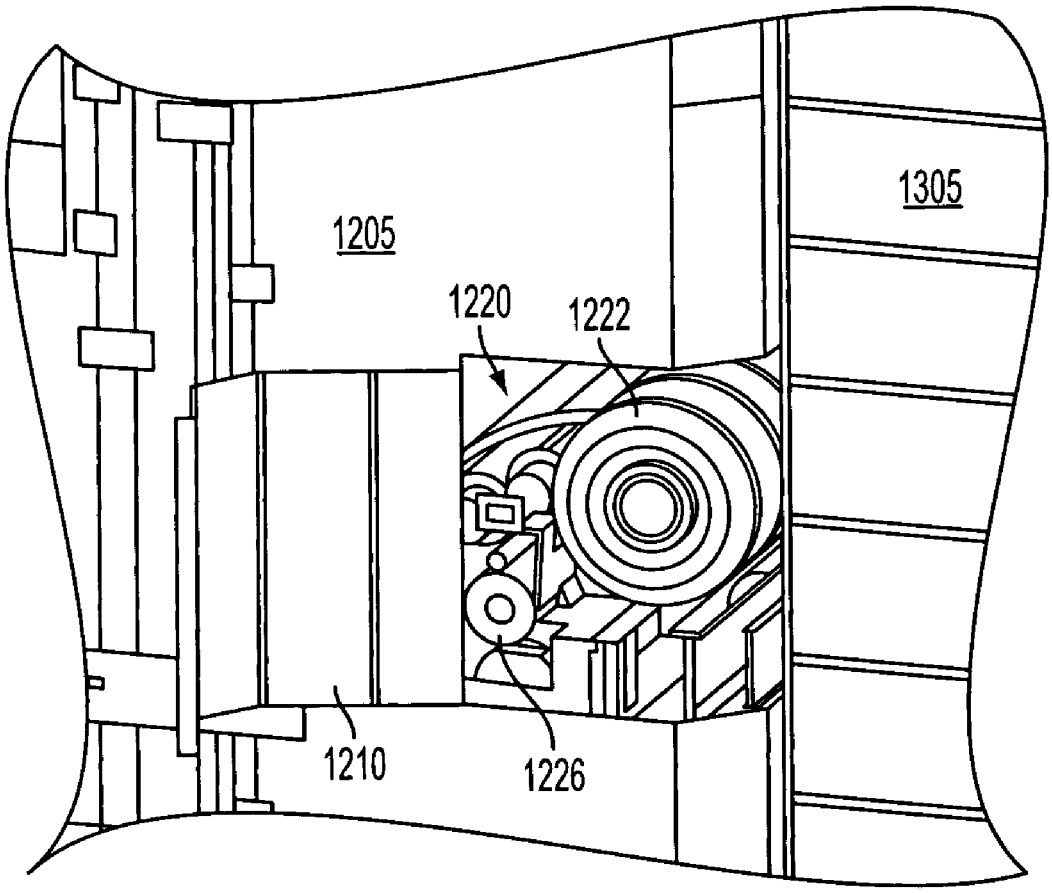
FIG. 2 is an enlarged partial view of the first dispenser housing in an opened condition.

FIG. 2 is an enlarged partial view of the first dispenser housing 1200 with the door 1210 in an opened position to provide partial access to the first dispensing system 1220. As shown in FIG. 2, the first dispensing system 1220 may include a first ink container 1222, a first hopper portion 1224 (shown in FIG. 3) and a corresponding developer housing 1226. The first ink container 1222 may be removed from the first dispenser housing 1200 by opening the first dispenser housing door 1200. The first ink container 1222 may be removed and replaced at any time, for example, when the ink in the first ink container 1222 may be low or when it may be desirable to run a job with a different color ink.

Figure 3:
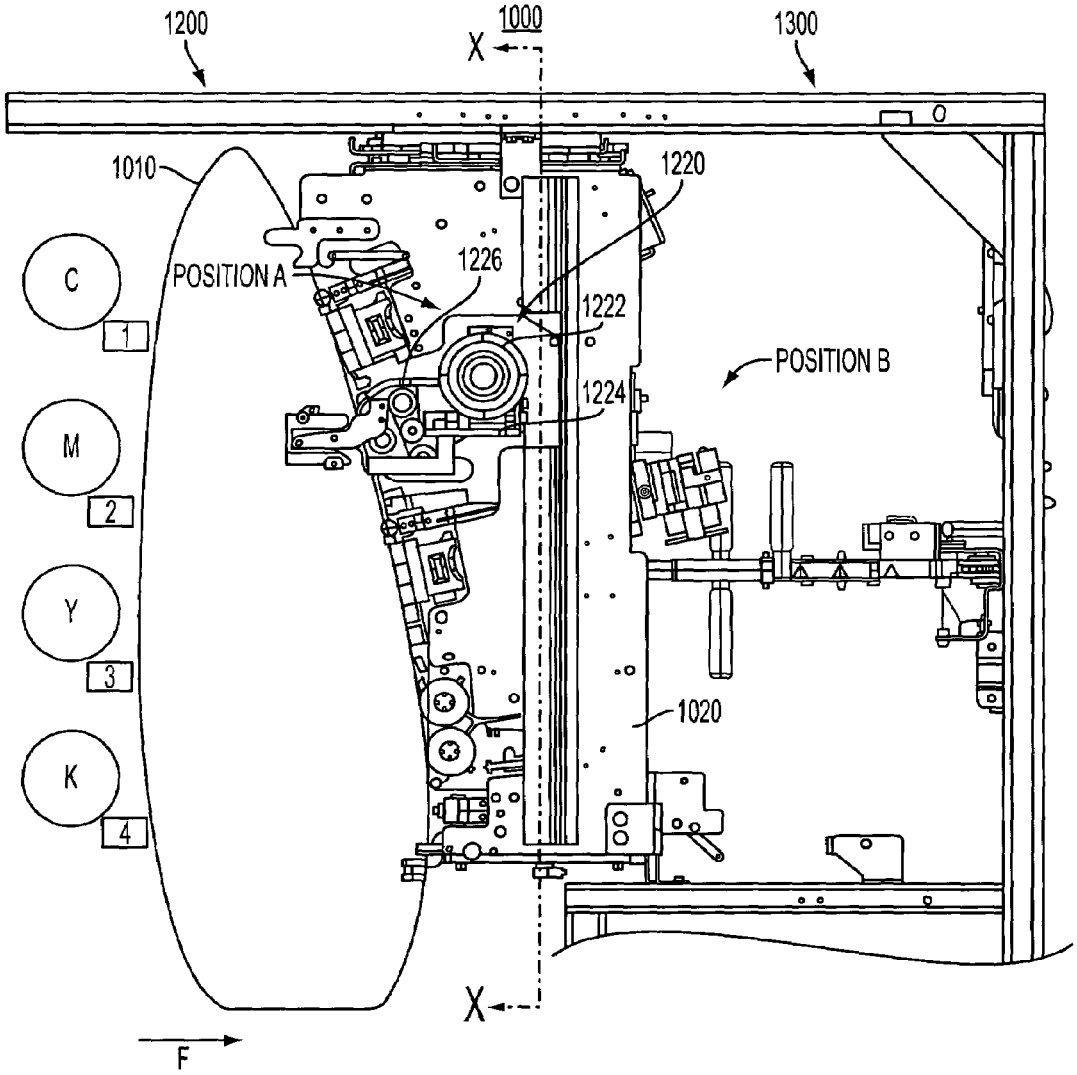
FIG. 3 is a front view of an interior of the first dispenser housing and an interior of the second dispenser housing.

FIG. 3 is a front view of an interior of the first dispenser housing 1200 and an interior of the second dispenser housing 1300. The first dispenser housing 1200 may contain the first dispensing system 1220. The first dispensing system 1220 may be provided upstream in the sheet feed direction F relative to the four substantially aligned ink containers C, M, Y, K at a position facing the image carrier 1010 so that image information may be developed by the developer housing 1226. In other words, the image carrier 1010 may be provided at a position located between the ink containers C, M, Y, K and the first dispensing system 1220. Therefore, the first dispensing system 1220 may act as an optional supply source of additional imaging media for developing image information located on the image carrier 1010.

The developer housing 1226 of the first dispensing system 1220 may develop image information located on the image carrier 1010 using imaging media provided from the first ink container 1222. The developer housing 1226 may be configured to receive imaging media by any known manner. For example, the first ink container 1222 may include an imaging media supply hole (not shown) in which the imaging media passes to the first hopper portion 1224 to enter an opening (not shown) in the developer housing 1226. The developer housing 1226 may include a developer bearing member, such as a developing roll, that may contact the image carrier 1010 to apply imaging media to image information. The developer housing 1226, as well as the first ink container 1222 and the first hopper portion 1224, may also include a developer agitating device (not shown), such as an auger, that assists in transferring imaging media from the first dispenser system 1220 to the developer housing 1226.

Figure 4:
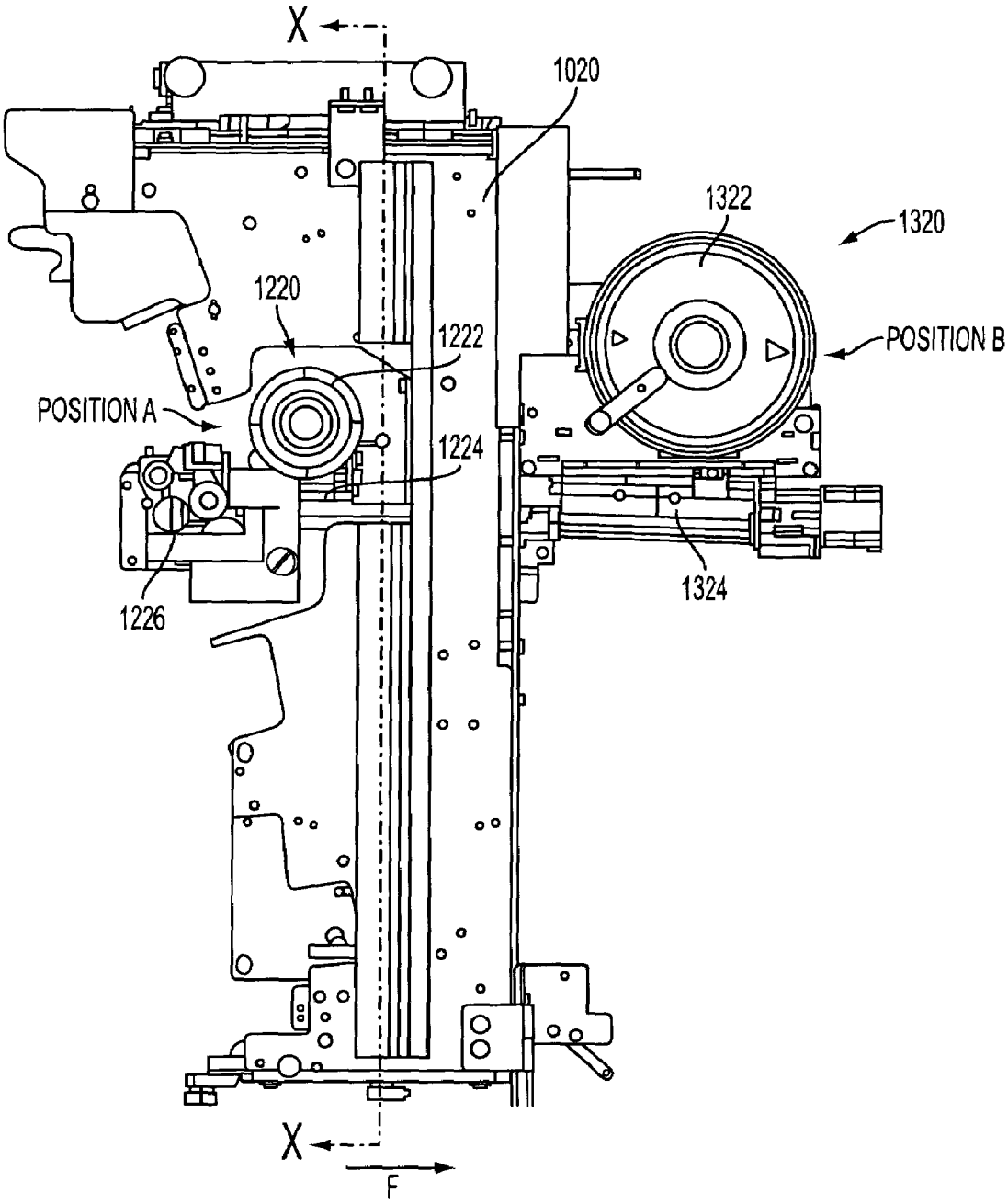
FIG. 4 is a front view of an exemplary first dispensing system and an exemplary second dispensing system disposed in the respective housings with respect to a front cover split line.

As shown in FIG. 3, the first dispenser housing 1200 may be configured to receive the first dispensing system 1220 at Position A and the second dispenser housing 1300 may be configured to receive a second dispensing system 1320 (as shown in FIG. 4) at Position B. A dividing frame 1020 may be located near a front cover split line X-X to divide the interior of the first developer housing 1200 and the second developer housing 1300. The configurations of the first dispenser housing 1200 and the second dispenser housing 1300 may include any known or later developed configurations capable of receiving and supporting the first dispensing system 1220 and the second dispensing system 1320 therein.

For example, it should be appreciated that the first dispenser housing 1200 may be configured to receive both the first dispensing system 1220 and the second dispensing system 1320. It should also be appreciated that the first dispenser housing 1200 and the second dispenser housing 1300 may be portions of a same housing so long as the first ink container 1222 and the second dispensing system 1320 interact with the same developer housing 1226 to supply imaging media to the image carrier 1010.

FIG. 4 is a front view of the first dispensing system 1220 and the second dispensing system 1320 disposed in the respective housings with respect to the front cover split line X-X. As shown in FIG. 4, the second dispensing system 1320 may be may be provided downstream in the sheet feed direction F relative to the first dispensing system 1220. However, it should be appreciated that the second dispensing system may be disposed at any location so long as the first dispensing system 1220 and the second dispensing system 1320 interact with the same developer housing 1226 to supply imaging media to the image carrier 1010.

Figure 5:
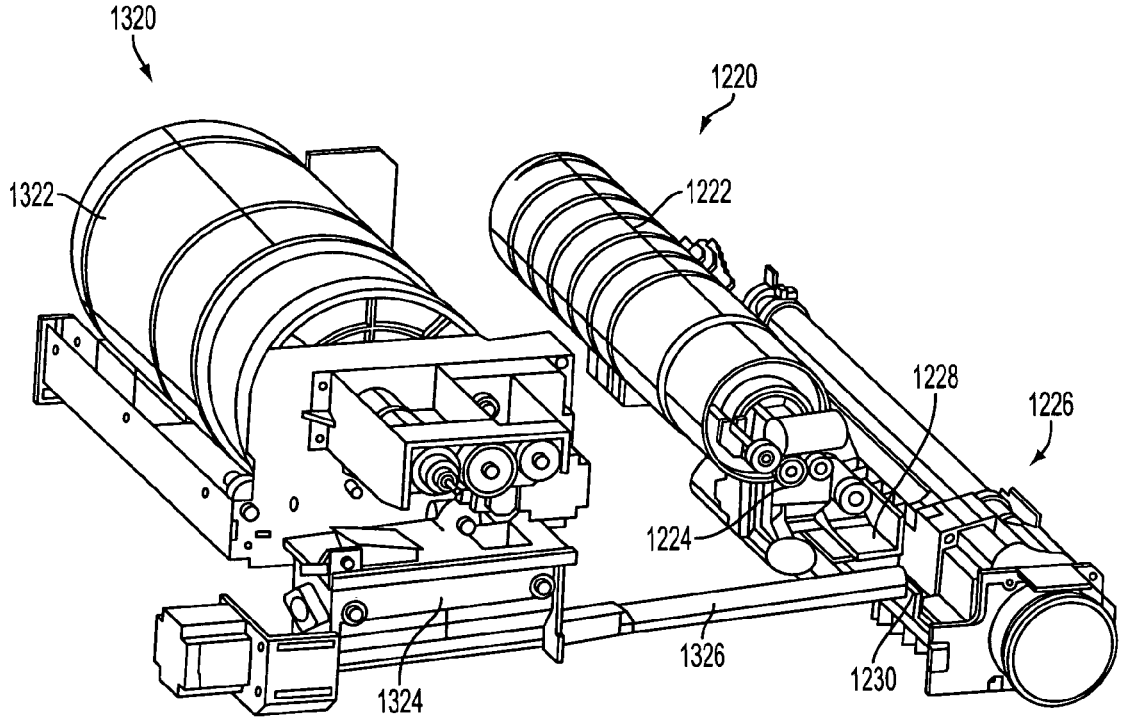
FIG. 5 is a rear view of the first dispensing system connected to the second dispensing system.

FIG. 5 is a rear view of the first dispensing system 1220 connected to the second dispensing system 1320. The second dispensing system 1320 may include a second ink container 1322, a second hopper portion 1324 and an ink transport mechanism 1326. The ink container 1322, the second hopper portion 1324 and the ink transport mechanism may each include a developer agitating device (not shown), such as an auger, that assists in respectively transferring imaging media from the second ink dispensing system 1320 to the developer housing 1226 of the first dispensing system 1220. The ink transport mechanism 1326 may be a tube, pipe or any other structure configured to support the second ink container 1322 and assist in transporting image media from the second ink container 1322 to the developer housing 1226 of the first dispensing system 1220.

As discussed above with respect to the first dispensing system 1220, the developer housing 1226 may be configured to receive imaging media from the first ink container 1222 and the second ink container 1322 by any known manner. For example, the first ink container may include an imaging media supply hole (not shown) in which the imaging media passes to the first hopper portion 1224 to enter a first ink supply port 1220, for example, a first opening in the developer housing 1226. Similarly, the second ink container 1222 may include an imaging media supply hole (not shown) in which the imaging media passes to the second hopper portion 1324 to enter a second ink supply port 1230, for example, a second opening in the developer housing 1226. Therefore, the second dispensing system 1320 may be provided as yet another optional supply source of additional imaging media for developing image information located on the image carrier 1010.

Operation of the exemplary image forming system 1000 including the first dispensing system 1220 and the second dispensing system 1320 is discussed in greater detail using the example set forth below.

For example, an operator of the image forming system 1000 may have a print job that requires a significant amount of a specific color. The operator may insert the first dispensing system 1220 that may include the first ink container 1222 containing toner of a specific color. The toner may include one of the common CMKY colors or a custom color, custom ink and the like.

If the first ink container 1222 contains one of the common CMYK inks, the first ink container 1222 may reduce the replacement frequency of CMYK ink containers containing that specific color. This may provide low cost, fast black or monochrome print jobs by reducing the idle time of the image forming apparatus resulting from replacement of a depleted cartridge or container. If the first ink container 1222 contains a custom color or custom ink, for example, Pantone© color, the first ink container 1222 may provide color flexibility and ensure color reproduction accuracy of a specified color in the print job.

The operator may also insert the second dispensing system 1320 in the image forming system 1000. The second dispensing system 1320 may provide similar benefits, such as reduction in replacement frequency and increased color flexibility, as discussed above with respect to the first dispensing system 1220. However, the second dispensing system 1320 may further reduce the replacement frequency of ink containers, provide even greater color flexibility and increase printing versatility.

For example, the operator of the image forming system 1000 may have a plurality of print jobs that require significant amounts of one or two specific colors. The operator may insert the first dispensing system 1220 that may include the first ink container 1222 containing toner of a first specific color and/or the second ink container 1322 containing toner of a second specific color. The toners may include one of the common CMKY colors or a custom color, custom ink and the like.

If both the first dispensing system 1220 and the second dispensing system 1320 are disposed in the image forming system 1000, the first ink container 1222 and the second ink container 1322 may contain the same toner of a specific color, that is, the first specific color and the second specific color may be the same. As a result, the replacement frequency of ink containers containing that specific color toner may be reduced. This may provide low cost, fast black or monochrome print jobs by reducing the idle time of the image forming apparatus resulting from replacement of a depleted cartridge or container. If the first ink container 1222 and the second ink container 1322 contain different color toners, that is, the first specified ink is different from the second specified ink, color flexibility, color reproduction accuracy of a specified colors in the print job and/or printing versatility may be enhanced.

For example, the operator may leave the second ink container 1322 of the second dispensing system 1320 in the image forming system while selectively changing the first ink container 1222 with corresponding ink containers each having a different color inks.

The image forming system 1000 may include a controller that may identify which print job to run, the various ink colors and/or types of each installed ink cartridge, and the exact ink cartridge to use for a given print job. The controller may activate a sensor to read an electronic chip that may be provided on each ink container to identify the proper ink cartridges containing a particular color and/or ink type required for a particular print job. If the operator inserts a CCU having an ink container containing a different color or ink than specified by the print job, the operator may be prevented from accessing further printing operations so that that print job cannot be performed. Therefore, the image forming system 1000 may determine that there is a color mismatch.

The controller may also control the first dispensing system 1220 and the second dispensing system 1320 so that imaging media contained in the respective first ink container 1222 and the second ink container 1322 are dispensed depending on the requirements of the print job and are not dispensed simultaneously. For example, the controller may use the second dispensing system 1320 for larger print jobs and the first dispensing system 1220 for smaller print jobs requiring significant amount of a single color of ink type. As a result, replacement frequency of ink containers may be further reduced. Also, the first dispensing system 1220 may be prevented from dispensing imaging media to the developer housing 1224 when the second dispensing system 1320 dispenses imaging media, and vice versa. As a result, ink contamination, for example, the mixing of different color inks and/or ink types, may be reduced.

Therefore, it is desirable to provide the image forming system 1000 including a support mechanism configured to receive both the first dispensing system 1220 and the second dispensing system 1320 that cooperates with the first dispensing system 1220 to increase color flexibility, reduce an amount of replacement servicing, and reduce the replacement burden on a operator who may be unfamiliar with handling the ink containers and/or cartridges.

Figure 6:
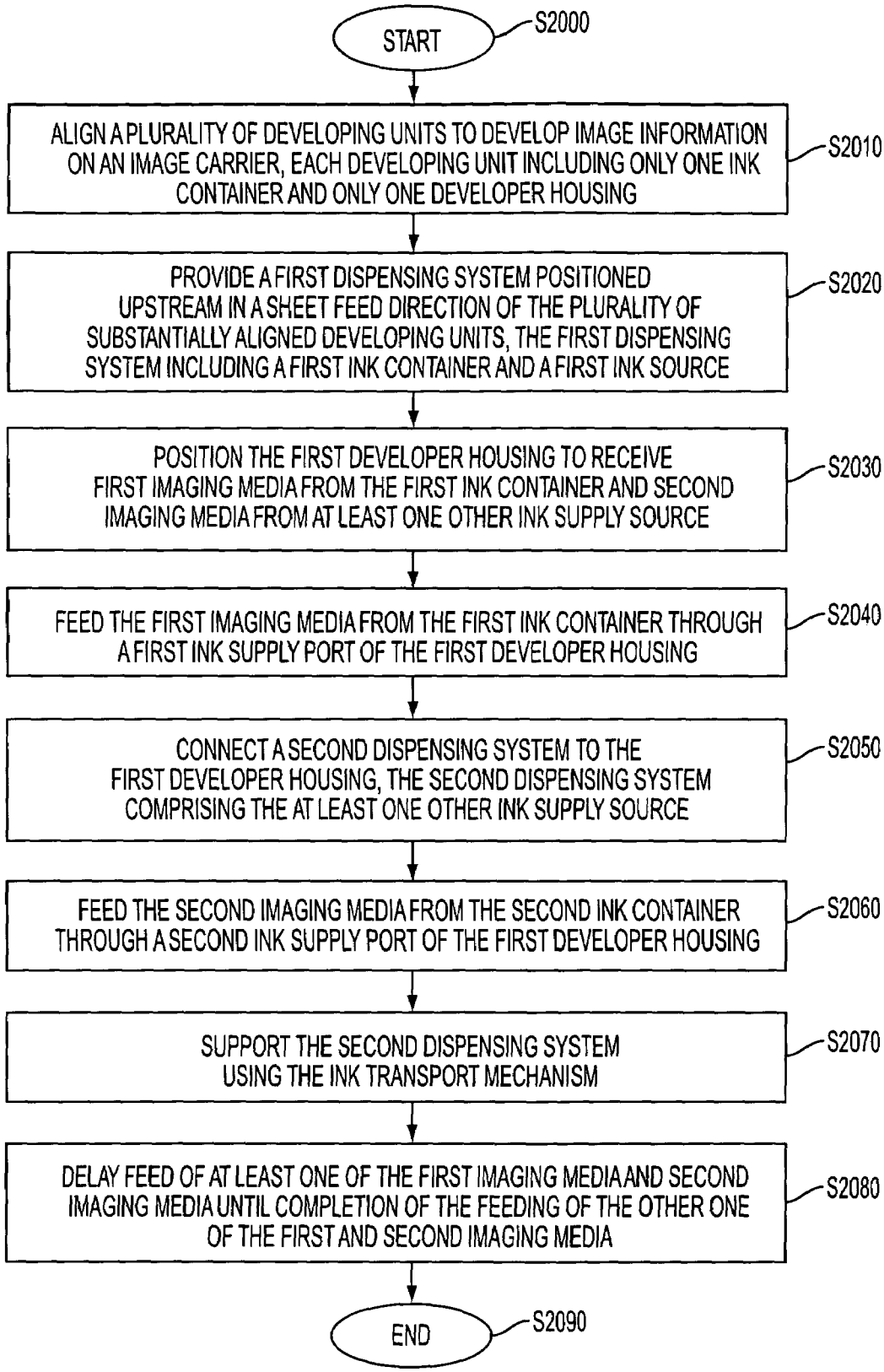
FIG. 6 is a flowchart outlining an exemplary method of dispensing imaging media.

FIG. 6 is a flowchart outlining one exemplary method of dispensing imaging media. As shown in FIG. 6, operation of the method begins in step S2000 and continues to step S2010 in which a plurality of developing units may be substantially aligned to develop image information on the image carrier 1010. Each developing unit may include only one ink container C, M, Y, K and only one developer housing 1, 2, 3, 4. Then, in step S2020, the first dispensing system 1220 may be positioned upstream in a sheet feed direction F of the plurality of substantially aligned developing units. The first dispensing system 1220 may include a first ink container 1222 and a first developer housing 1226.

Next, in step S2030, the first developer housing 1226 may be positioned to receive first imaging media from the first ink container 1222 and second imaging media from at least one other ink supply source. The second dispensing system 1320 may include the at least one other ink supply source. Then, in step S2040, the first imaging media may be fed from the first ink container 1222 through a first ink supply port 1228 of the first developer housing 1226.

Next, in step S2050, the second dispensing system S1320 may be connected to the first developer housing 1226. Then, in step S2060, the second imaging media may be fed from the second ink container 1322 through a second ink supply port 1230 of the first developer housing 1226.

Next, in step S2070, the second dispensing system 1320 may be supported using the ink transporting mechanism 1326. Then, in step S2080, feeding of at least one of the first imaging media and second imaging media may be delayed until completion of the feeding of the other one of the first and second imaging media. Operation then continues to step S2090, in which the method ends.

Figure 7:
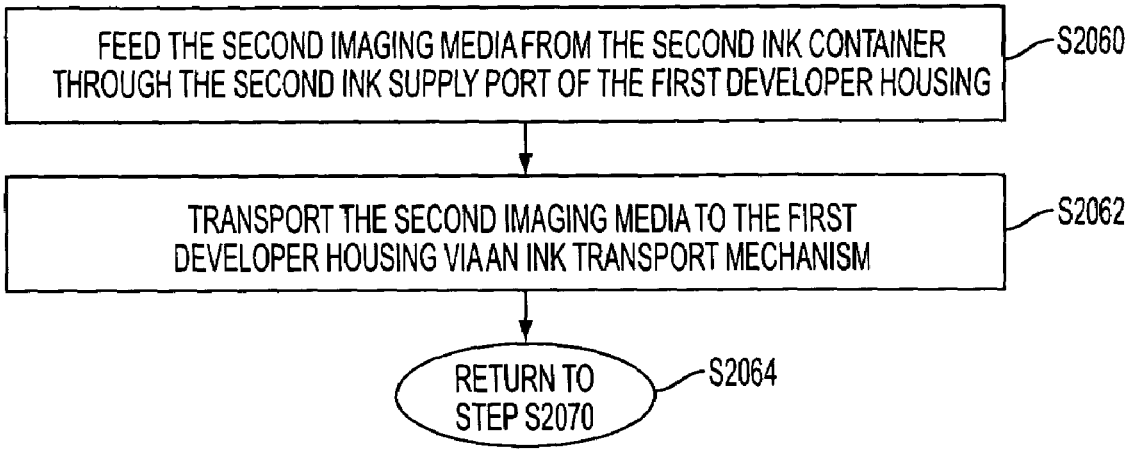
FIG. 7 is a flowchart outlining in greater detail an exemplary method of feeding second imaging media from a second ink container through a second ink supply port of the first developer housing.

FIG. 7 is a flowchart outlining in greater detail an exemplary method of feeding second imaging media from a second ink container through a second ink supply port of the first developer housing. As shown in FIG. 7, operation of the method continues from step S2060 to step S2062, in which the second imaging media may be transported to the first developer housing 1226 via the ink transporting mechanism 1326. Operation then continues to step S2064, in which operation returns to step S2070.

Figure 8:
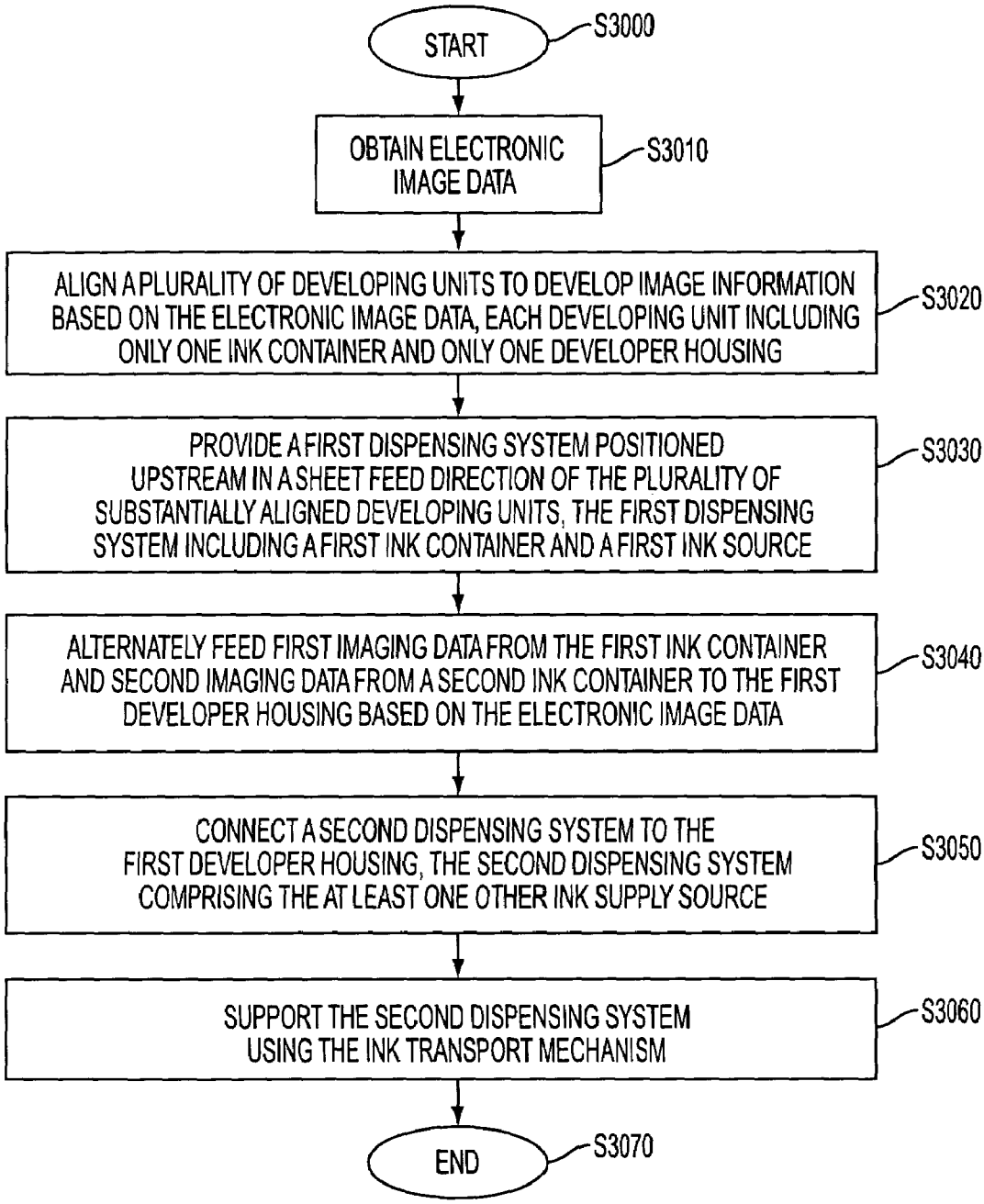
FIG. 8 is a flowchart outlining another exemplary method of dispensing imaging media.

FIG. 8 is a flowchart outlining another exemplary method of dispensing imaging media. As shown in FIG. 8, operation of the method begins in step S3000 and continues to step S3010 in which electronic image data of a print job may be obtained. Then, in step S3020, a plurality of developing units may be substantially aligned to develop image information based on the electronic image data. Each developing unit may include only one ink container C, M, Y, K and only one developer housing 1, 2, 3, 4.

Next, in step S3030, the first dispensing system 1220 may be positioned upstream in a sheet feed direction F of the plurality of substantially aligned developing units. The first dispensing system 1220 may include a first ink container 1222 and a first developer housing 1226. Then, in step S3040, first imaging media may be alternately fed from the first ink container 1222 and second imaging media from a second ink container 1322 to the first developer housing 1226 based on the electronic image data.

Next, in step S3050, the second dispensing system S 1320 may be connected to the first developer housing 1226. Then, in step S3060, the second dispensing system 1320 may be supported using the ink transporting mechanism 1326. Operation then continues to step S3070, in which the method ends.

Figure 9:
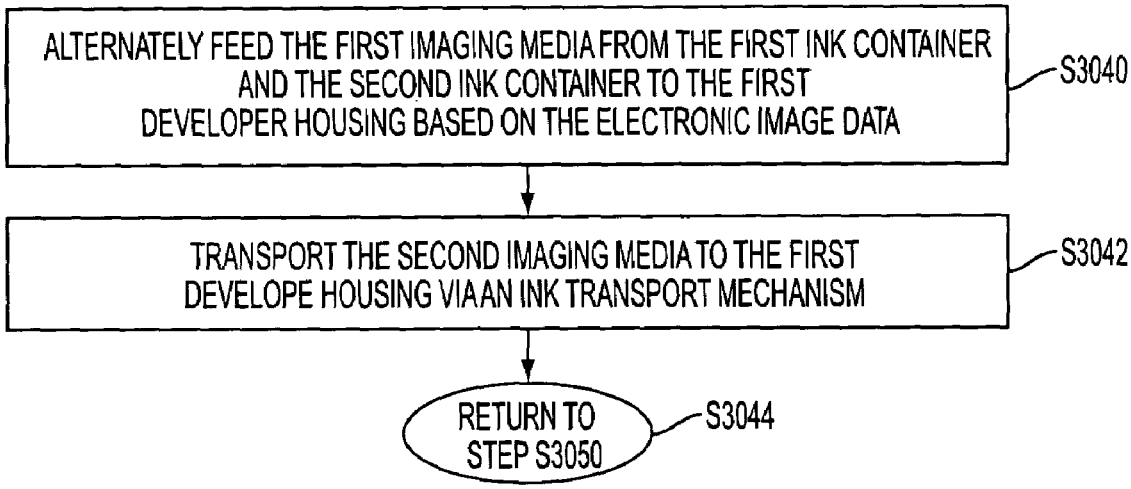
FIG. 9 is a flowchart outlining an exemplary method of feeding first imaging media from a first ink container and a second ink container to the first developer housing based on electronic image data.

FIG. 9 is a flowchart outlining an exemplary method of alternatively feeding first imaging media from a first ink container and a second ink container to the first developer housing based on electronic image data. As shown in FIG. 9, operation of the method continues from step S3040 to step S3042, in which the second imaging media may be transported to the first developer housing 1226 via the ink transporting mechanism 1326. Operation then continues to step S3044, in which operation returns to step S3050.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What may be claimed is:

1. A multiple dispensing system, comprising:

an image carrier;

a plurality of substantially aligned developing units positioned to develop image information on the image carrier, each developing unit including only one ink container and only one developer housing; and a first dispensing system positioned upstream in a sheet feed direction of the plurality of substantially aligned developing units, the first dispensing system including a first ink container and a first developer housing, the first developer housing being configured to receive first imaging media from the first ink container and second imaging media from at least one other ink supply source, wherein the first imaging media and the second imaging media are of a same specified color.

2. The multiple dispensing system of claim 1, wherein the at least one other ink supply source comprises a second dispensing system that dispenses the second imaging media to the first developer housing.

3. The multiple dispensing system of claim 2, wherein the second dispensing system comprises a second ink container configured to store the second imaging media and to supply the second imaging media to the first developer housing.

4. The multiple dispensing system of claim 3, wherein the second dispensing system further comprises an ink transporting mechanism configured to transport the second imaging media from the second ink container to the first developer housing.

5. The multiple dispensing system of claim 4, wherein the ink transporting mechanism comprises a pipe.

6. The multiple dispensing system of claim 4, wherein the ink transporting mechanism is configured to support the second dispensing system.

7. The multiple dispensing system of claim 3, wherein the second ink container includes a larger storage capacity than a storage capacity of the first ink container.

8. The multiple dispensing system of claim 1, wherein the first developer housing includes a first ink supply port to receive the first imaging media from the first ink container and a second ink supply port to receive the second imaging media from the at least one other ink supply source.

9. A xerographic device comprising the multiple dispensing system of claim 1.

10. A method of dispensing imaging media, comprising:

substantially aligning a plurality of developing units to develop image information on an image carrier, each developing unit including only one ink container and only one developer housing;

providing a first dispensing system positioned upstream in a sheet feed direction of the plurality of substantially aligned developing units, the first dispensing system including a first ink container and a first developer housing; and positioning the first developer housing to receive first imaging media from the first ink container and second imaging media from at least one other ink supply source, wherein the first imaging media and the second imaging media are of a same specified color.

11. The method of claim 10, further comprising feeding the first imaging media from the first ink container through a first ink supply port of the first developer housing.

12. The method of claim 11, further comprising connecting a second dispensing system to the first developer housing, wherein the second dispensing system comprises at least one other ink supply source.

13. The method of claim 12, further comprising feeding the second imaging media from the second ink container through a second ink supply port of the first developer housing.

14. The method of claim 13, wherein feeding the second imaging media comprises transporting the second imaging media to the first developer housing via an ink transporting mechanism.

15. The method claim 14, further comprising supporting the second dispensing system using the ink transporting mechanism.

16. The method of claim 13, further comprising delaying feeding of at least one of the first imaging media and second imaging media until completion of the feeding of the other one of the first and second imaging media.

17. A method of dispensing imaging media, comprising:

obtaining electronic image data;

substantially aligning a plurality of developing units to develop image information based on the electronic image data, each developing unit including only one ink container and only one developer housing;

providing a first dispensing system positioned upstream in a sheet feed direction of the plurality of substantially aligned developing units, the first dispensing system including a first ink container and a first developer housing; and alternately feeding first imaging media from the first ink container and second imaging media from a second ink container to the first developer housing based on the electronic image data, wherein the first imaging media and the second imaging media are of a same specified color.

18. The method of claim 17, further comprising connecting a second dispensing system to the first developer housing, wherein the second dispense system comprises the at least one other ink supply source.

19. The method of claim 17, wherein alternately feeding first imaging media from the first ink container and second imaging media from a second ink container comprises transporting the second imaging media to the first developer housing via an ink transporting mechanism.

20. The method of claim 19, further comprising supporting the second dispensing system using the ink transporting mechanism.

* * * * *